United States Patent [19]

Pelsue et al.

[11] 4,207,685

[45] Jun. 17, 1980

[54] AIR DISTRIBUTION SHEATH

[75] Inventors: Bradley A. Pelsue, Lakewood; Allan E. Beavers, Littleton, both of Colo.

[73] Assignee: T. A. Pelsue Company, Arapahoe, Colo.

[21] Appl. No.: 907,048

[22] Filed: May 18, 1978

[51] Int. Cl.[2] ..... F26B 25/14

[52] U.S. Cl. ..... 34/107; 156/86; 156/497; 285/381

[58] Field of Search ..... 156/86, 49, 497; 174/25, 92, 107; 34/107, 202; 285/381, DIG. 10, 423; 403/273; 138/35, 99; 29/447; 150/51, 52 R, DIG. 1; 53/442, 557

[56] References Cited

U.S. PATENT DOCUMENTS

| | | | |
|---|---|---|---|
| 440,785 | 11/1890 | Bartliff | 150/DIG. 1 |
| 1,283,125 | 10/1918 | Ewers | 138/35 X |
| 1,748,087 | 2/1930 | Spanel | 34/202 X |
| 1,835,922 | 12/1931 | Zeiss et al. | 156/49 X |
| 2,706,988 | 4/1955 | Weber | 34/202 X |
| 2,731,944 | 1/1956 | Francis | 34/107 X |
| 3,368,289 | 2/1968 | Pelsue | 34/232 |
| 3,481,805 | 12/1969 | Holmes et al. | 156/86 |
| 3,886,669 | 6/1975 | Pelsue | 34/232 X |
| 4,054,474 | 10/1977 | Collins et al. | 156/86 |
| 4,109,978 | 8/1978 | Ernst et al. | 156/86 |

FOREIGN PATENT DOCUMENTS

| | | | |
|---|---|---|---|
| 233643 | 5/1964 | Austria | 156/49 |
| 1011044 | 6/1952 | France | 156/49 |

*Primary Examiner*—Albert J. Makay
*Assistant Examiner*—Harold Joyce
*Attorney, Agent, or Firm*—Edwin L. Spangler, Jr.

[57] ABSTRACT

This invention relates to a heat-resistant air-distributing sheath foldable into encircling relation about a section of damaged cable or the like encased in a heat-shrinkable sleeve, said sheath being characterized by a tangentially-directed tubular inlet connectable to a source of forced hot air, cooperating pairs of arcuate rigid ribs housed within circumferential pockets adjacent opposite ends of said sheath movable from an open cable-receiving position into a closed cable-encircling one, means depending from said sheath for tying or otherwise hanging same from an overhead support, flexible tubular cuffs at opposite ends equipped with drawstrings for regulating the size of the openings through which the air exits the sheath, and a deflector at the point where the air enters the sheath effective to direct the airflow in a helical path towards the opposite open ends thereof.

4 Claims, 3 Drawing Figures

AIR DISTRIBUTION SHEATH

Sheathed underground cables, some of which are pressurized, are from time to time in need of repair. Once the repairs have been made, the cable must be resheathed in an air-tight jacket impervious to moisture.

In recent years, several heat-shrinkable jackets have been developed which are folded into loosely-enveloping relation around the repaired section and closed by a suitable longitudinally-extending fastener which completes the tubular sleeve. Unfortunately, a number of problems have arisen in connection with the use of these sleeves in above ground as well as underground installations, the main one being the difficulty in heating it uniformly. Above ground where, in most instances, open flame can be used, an experienced and talented repairman can, under most circumstances, use a torch to sweep the surface of the sleeve without creating hot spots thereby completing the repair. Even this operation is a tricky one requiring considerable skill, patience and attention to detail, so much so in fact that the technique is not widely used.

Underground, the problems are multiplied for the simple reason that under all but very rare circumstances, no open flame can be used. This means, of course, that indirect heat must be used, generally in the form of a flaming non-explosive heat transfer medium like, for example, hot air. Fortunately, portable forced air heaters have been developed which are capable of delivering hot air through conduits to a remote point of use at uniform temperatures of around 400° F., once such unit forming the subject matter of U.S. Pat. No. 2,811,962. Merely producing the hot air at the required temperature and delivering it to the site of the repair has proven to be much simpler than using this medium to uniformly and dependably heat the shrinkable sleeve into a tight-fitting water and air-impervious jacket encasing the damaged area. Hot spotting causes the sleeve to melt and become useless for its intended purpose. Conversely, the failure to get certain areas heated up to the shrink temperature of the sleeve naturally resulted in a failure also. Even handling of the jacket or other apparatus used to confine the heat to the desired area has proven to be a source of danger to the repairman if, for example, the unit included exposed metal parts such as zippers, snap fasteners and the like.

The closest prior art known to the inventors is found disclosed in T. A. Pelsue's U.S. Pat. Nos. 3,368,289 and 3,886,669, both of which are directed to air drying jackets for use in drying out underground electrical cables. Jackets such as these have proven to be unsatisfactory for use in high temperature applications for which the jacket of the instant invention was designed because the exposed metal parts become too hot to handle; yet, they must be touched repeatedly in order to put the jacket in place around the cable. More important, however, is the failure of these prior art jackets to distribute the heat evenly along and around the heat-shrinkable sleeve while, at the same time, eliminating blisters and hot spots.

Fortunately, it has now been found that these and other shortcomings inherent in the prior art attempts at forcing hot air into a jacket for purposes of shrinking a heat-shrinkable sleeve onto a repaired cable section can, in large measure, be overcome by the simple, yet unobvious, expedient of encasing the sleeve in a heat-resistant fabric sheath suspended from an overhead support and stiffened so as to remain in spaced relation outside the sleeve so that the air can circulate freely therearound. The incoming air is introduced intermediate the ends of the sheath more or less tangentially so as to not impinge directly upon the sleeve but instead circulate around the outside of the latter. The stream of air entering the sheath is, preferably, passed through a deflector which splits it into two substreams circulating in helical paths toward the opposite open ends of the sheath. Flexible cuffs provided at opposite ends have drawstrings along their free edges effective upon actuation to vary the size of the exhaust opening in the end thereof so as to confine the hot air for the interval required to shrink the sleeve while, at the same time, allowing it to exit the sheath before overheating occurs. The only metal parts are pairs of arcuate generally-semicircular stiffening ribs, all but the overlapped ends of which are permanently housed in circumferentially-extending pockets therefor. All parts that must be handled are fabricated from or encased within heat-resistant fabric sheets, cord or woven strapping that remains relatively cool to the touch, at least cool enough so that it can be handled with gloves and without the danger of being burned.

It is, therefore, the principal object of the present invention to provide a novel and improved air-distributing sheath for use around damaged cables to localize the heat supplied from a remote forced air source for purposes of shrinking a heat-shrinkable sleeve onto the repaired area of the latter.

A second objective is the provision of a device of the character described which is effective to direct the hot incoming air both around and throughout the length of the sleeve so as to maintain same at a substantially uniform temperature above that at which it shrinks but less than that at which it melts.

Another object of the within described invention is to provide a sheath for temporarily encasing repaired areas of damaged jacketed cables while heat-shrinkable sleeves are being applied thereto that is fabricated almost entirely from heat-resistant fabric materials and the only metal parts used are encased inside the latter.

Still another objective is the provision of a device of the type herein disclosed and claimed that is versatile and can accommodate repaired areas of various diameters and length.

An additional objective is the provision of a foldable rib-stiffened sheath that can accommodate different flow rates of hot forced air through means for adjusting and regulating the escape of air therefrom.

Further objects are to provide an air bag for circulating hot air around a heat-shrinkable sheath encasing a repaired area of a cable which is simple, easy to use, safe, lightweight, compact, dependable, has no moving parts and is even somewhat decorative.

Other objects will be in part apparent and in part pointed out specifically hereinafter in connection with the description of the drawings that follows, and in which.

Figure 1:
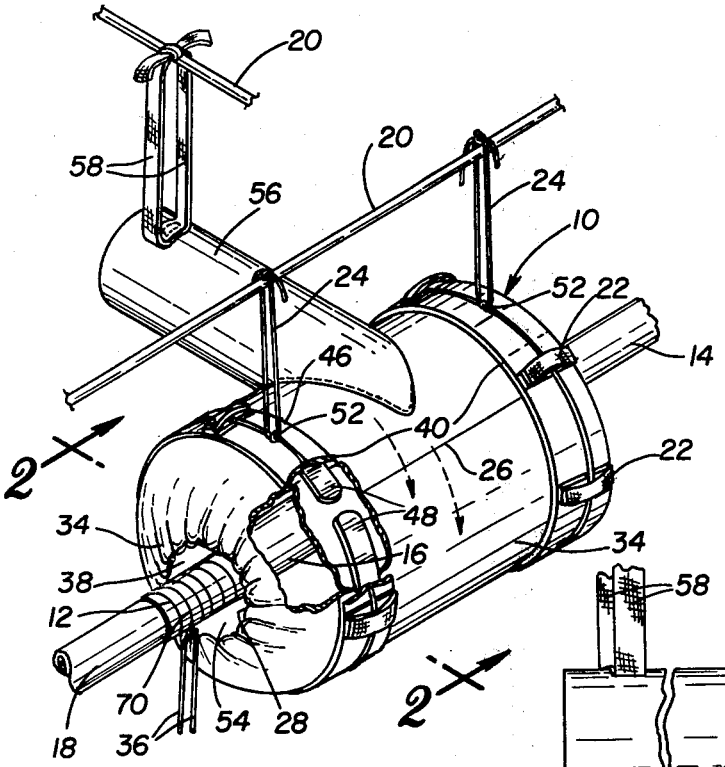
FIG. 1 is a perspective view showing the air-distributing sheath of the present invention hung in place from an overhead support in encircling relation around a repaired section of damaged cable onto which a heat-shrinkable sheath is being applied, portions thereof having been broken away to expose the interior construction.
Figure 2:
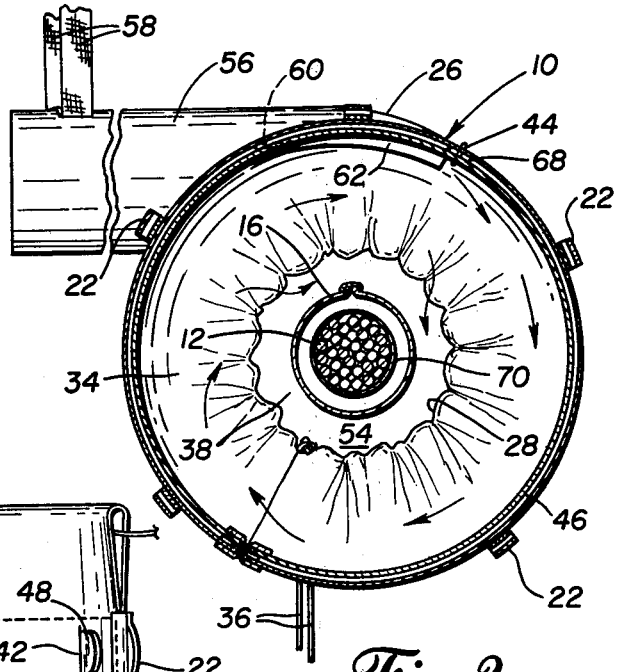
FIG. 2 is a section to an enlarged scale taken along line 2—2 of FIG. 1, again having portions broken away to conserve space; and, FIG. 3 is a plan view to a slightly larger scale than FIG. 2 showing the sheath opened up to reveal its internal construction.

Referring next to the drawings for detailed description of the present invention and, initially, to FIGS. 1 and 2 for this purpose, reference numeral 10 has been selected to identify the sheath in a general way while numeral 12 designates the section of repaired cable 14 to which the heat-shrinkable sleeve 16 is to be shrunk. The cable 14 is of the jacketed type, the jacket 18 thereof having been removed in the damaged area to gain access to the individual conductors housed therein. Cables such as these, when run underground as shown, are hung from overhead supports 20 provided for this purpose. These same supports are, therefore, available for use as a means for suspending the sheath 10 in the cable-encircling position shown in FIGS. 1 and 2. In the particular form shown, a series of circumferentially-spaced hanger/cord loops 22 encircle the sheath adjacent opposite ends thereof and a cord 24 is reaved through each set of loops and used in the manner shown in FIG. 1 to hang same from the overhead support 20 extending along the cable 14 that has been repaired in spaced relation thereabove. The hanger/cord loops as well as the cord itself need not be fabricated from materials highly resistant to heat since they are located entirely on the outside of the sheath and, therefore, are subjected primarily to only modest temperatures of at most 200° F. or so since the body 24 of the sheath defines an insulating barrier between these elements and the high temperatures inside thereof. Thus, ordinary clothesline cord and woven fabric webbing, both of which will easily withstand boiling water, can be used with good results. The body 24 of the sheath, on the other hand, might withstand temperatures of 400° F. as a minimum and, preferably, in excess of 500° F. which is the temperature of the air leaving the forced air heating unit. While this air is some 100° cooler by the time it enters the sheath, the latter element should nevertheless, be able to withstand the maximum possible temperature to which it could be subjected in use and still leave a margin for safety. Silicon-impregnated fiberglass is one material that satisfies these requirements while, at the same time, remaining pliable and relatively cool to the touch, especially when wearing gloves.

Figure 3:
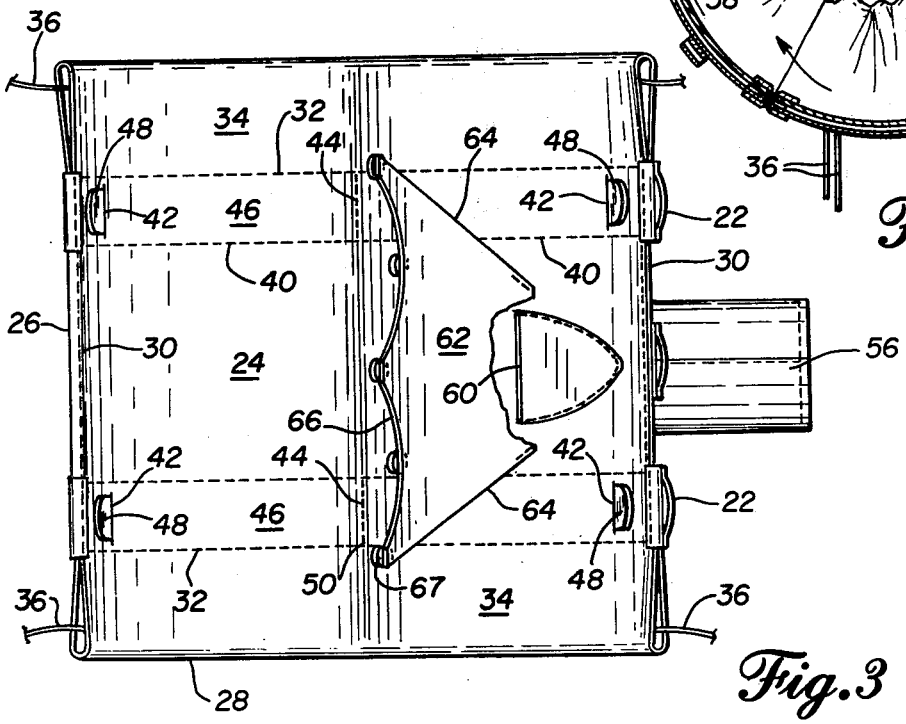

Next, referring to FIG. 3, the body 24 of the sheath will be seen to be rectangular so as to define transversely-spaced parallel side margins 26 and longitudinally-spaced parallel ends 28. In the particular form shown, the body is a flattened tube of fabric open along side margins 26 except for the marginal flaps 30 that are folded over and sewn along the center section of each side. These flaps 30 terminate short of the ends 28 of the body and cooperate with an outer row of stitching 32 paralleling the adjacent end in spaced substantially parallel relation thereto to define tubular blousable cuffs 34. These tubular cuffs receive drawstrings 36 that are used to gather the free edges thereof in around the cable 14 as shown in FIGS. 2 and 3 so as to leave an annular exhaust passage 38 therearound. The free edges of the cuffs just referred to, of course, comprise the previously-described ends 28 of the body before it is formed into a tubular configuration and the cuffs gathered.

Now, a second row of stitching 40 extends transversely of the body spaced inside the outside row 32 thereof in substantially parallel relation to the latter. These parallel rows of stitching cooperate with one another and with longitudinally-extending slits 42 at the opposite extremities thereof and a longitudinal row of stitches 44 approximately midway between these slits to define a pair of pockets 46 arranged in end-to-end relation. Slits 42 are on the inside of the body and each pocket receives a generally semicircular strap metal stiffening rib 48. These ribs constitute the only metal parts of the assembly and, once encased inside the pockets as shown, they lie well inside the sheath where they cannot burn the personnel working therewith.

Other features of the sheath are most clearly revealed in FIG. 3; however, before making specific reference thereto, the attention is once again directed to FIGS. 1 and 2 for an explanation of how it is mounted in annularly-spaced cable-encircling relation. The two-part stiffening ribs 48 cooperate to leave a longitudinally-extending fabric hinge 50 along stitched areas 44 which enables the halves of the body to be opened clamshell-fashion to receive the repaired section 12 of the cable 14 housed in the shrinkable sleeve 16. Now, a glance at FIG. 1 will reveal that the series of hanger/cord loops 20 are aligned circumferentially with the pockets 46 so that when the side margins 26 of the body are brought together into overlapped relation, the selfsame hanger cords 24 used to hang the sheath from the overhead support 20 function, when tied together as shown as 52 to maintain the ribs in hoop-forming assembled relation as they encircle the outside of the latter. Looking at FIG. 3, it can be seen that when thus closed and hung from overhead support 20, the sheath defines inside thereof a continuous annular airflow passage 54 encircling the repaired section 12 of the cable 14 and the sleeve 16 jacketing same. After being mounted, the drawstrings 36 can be drawn in to gather the cuffs 34 into bloused pouch-forming relation about the emerging cable. A minimum of approximately ½ inch space should be left between the cable and the gathered free edge of the cuff to leave a sufficient exhaust passage 38. If, during the actual shrinking operation, overheating occurs or a significant back pressure develops, it is, of course, a simple matter to open up the cuff and enlarge the exhaust opening allowing more air to escape therethrough.

To get hot air into the sheath, it is provided with a fabric duct 56 located approximately midway between its ends and entering same essentially tangentially. Sewn to inlet duct 56 in a fabric hanger/strap 58 which, in the manner of cords 24, can be tied around a suitably located overhead support 20. Entering this duct is the hot air from a remotely located forced air heater (not shown). Ordinarily, a flexible conduit (not shown) is connected between the surface heating unit and sheath inlet, such a conduit being relatively heavy and thus requiring the support offered by hanger/strap 58; otherwise, such a conduit would impose a load upon the fabric sheath that could, conceivably, inhibit the free circulation of air around the cable inside thereof.

Next, with reference to FIGS. 2 and 3, it can be seen that duct 56 opens onto the inside of the sheath through a transverse slit 60 extending between the inner rows 40 of stitches and lying beneath fabric deflector 62. This deflector 62 is generally trapezoida in shape and the side margins 64 thereof are fastened to the inside surface of the body, usually cemented thereto, because of the difficulties associated with sewing same at this point.

The edge 66 of the deflector 62 remote from slit 60 and downstream of the air entering the sheath tangentially therethrough is preferably held in spaced relation to the inside surface of the latter by spacers 68, five of which have been shown, one at each corner, a third in the middle, and the fourth and fifth spaced between the first three. Now, this deflector 62 is so shaped and arranged relative to slit 60 that it receives air therefrom and essentially splits it into two streams that run on opposite sides of the middle spacer and diverge as they spread along divergent side margins 64. These airstreams tend to circulate in helical paths from the center of the sheath toward the opposite open ends thereof before emerging through exhaust openings 38 therein. The separate paths of these airstreams have been shown by the arrows in FIG. 1.

Finally, with reference to FIGS. 1 and 2 again, some mention should, perhaps, be made of the heat-shrinkable sleeve 16. It is shown in FIG. 2 apparently unsupported in coaxial spaced relation around the outside of the repaired section 12 of the cable. Actually, tape 70 (FIG. 1) can be wrapped around the extremities of the repaired section and used as supports to hold the sleeve in the coaxial position in which it is shown in FIG. 2 while the shrinking operation is taking place. There are other ways of supporting the sleeve in much the same position; however, since these form no part of the present invention, little reason exists for setting them forth in detail.

What is claimed is:

1. An air-distributing sheath for use in circulating hot air around a heat-shrinkable sleeve encasing a workpiece which comprises: a generally-rectangular sheet of heat-resistant fabric foldable into encircling relation around the sleeve to define a tubular jacket therefor open at both ends and along a joint extending therebetween, said jacket being sized to encircle said sleeve in annular spaced relation outside the latter, and said jacket having a pair of circumferential pockets therein arranged in axially-spaced substantially parallel relation to one another and to the adjacent open ends, the portions of said jacket between said pockets and the open end adjacent thereto defining blousable cuffs effective when the free edges thereof are gathered to reduce the size of said adjacent open end; an air-delivery conduit having one end connectable to a source of hot air under pressure and the other end thereof connected to deliver the latter into said tubular jacket substantially tangentially; and, a pair of arcuate rigid rib segments disposed in end to end relation within each pocket effective to maintain the tubular shape thereof to the degree required for free circulation of the hot air around the sleeve, said rib segments having adjacent ends cooperating with one another and the jacket fabric therebetween to define a hinge openable to the extent required to admit the sleeve and workpiece through the joint in said jacket.

2. The air-distributing sheath as set forth in claim 1 in which: the free edge of each cuff is bordered by a tubular hem; and, in which a drawstring is disposed within said hem effective upon actuation to gather the free edge, said cuffs cooperating with one another to vary the size of the exhaust openings defined between the sleeve and the open jacket ends so as to control the temperature inside the latter.

3. The air-distributing sheath as set forth in claim 1 in which: the air-delivery conduit is connected to introduce the hot air intermediate the open ends of the jacket; and, in which means comprising a deflector is disposed within the jacket at the point therein where the hot air enters tangentially from the air-delivery conduit, said deflector being so shaped and located as to shield a sleeve within said jacket from the direct flow of hot air entering same and to divide the incoming hot airstream into two parts circulating in opposite directions following helical paths toward one of said open jacket ends.

4. The air-distributing sheath as set forth in claim 1 in which: an aligned series of circumferentially-spaced fabric loops encircle each pocket; and, in which belt-forming means are reaved through each series of loops effective when the ends thereof are joined together to maintain the segments of said ribs in hoop-forming circular relation.

* * * * *